US010267500B2

(12) United States Patent
He et al.

(10) Patent No.: US 10,267,500 B2
(45) Date of Patent: Apr. 23, 2019

(54) END CAP OF LAMP TUBE AND ILLUMINATING DEVICE USING SAID END CAP

(71) Applicant: OSRAM GmbH, Munich (DE)

(72) Inventors: Junnan He, Shenzhen (CN); Yunsong Zhang, Shenzhen (CN); Quansheng Liu, Shenzhen (CN); Shijun Nie, Shenzhen (CN)

(73) Assignee: LEDVANCE GMBH, Garching Bei München (DE)

( * ) Notice: Subject to any disclaimer, the term of this patent is extended or adjusted under 35 U.S.C. 154(b) by 398 days.

(21) Appl. No.: 14/896,407

(22) PCT Filed: May 28, 2014

(86) PCT No.: PCT/EP2014/061034
§ 371 (c)(1),
(2) Date: Dec. 7, 2015

(87) PCT Pub. No.: WO2014/202361
PCT Pub. Date: Dec. 24, 2014

(65) Prior Publication Data

US 2016/0123543 A1 May 5, 2016

(30) Foreign Application Priority Data

Jun. 18, 2013 (CN) ..... 2013 1 0240844

(51) Int. Cl.
*F21K 9/272* (2016.01)
*F21V 21/30* (2006.01)
(Continued)

(52) U.S. Cl.
CPC ..... *F21V 23/003* (2013.01); *F21K 9/272* (2016.08); *F21K 9/278* (2016.08); *F21K 9/65* (2016.08);
(Continued)

(58) Field of Classification Search
CPC . F21K 9/272; F21K 9/27; F21V 21/30; F21V 15/005; F21V 17/005; F21V 14/02
See application file for complete search history.

(56) References Cited

U.S. PATENT DOCUMENTS 7,052,171 B1 * 5/2006 Lefebvre ..... F21V 21/30 362/217.12
2009/0159919 A1 * 6/2009 Simon ..... F21K 9/175 257/99
(Continued)

FOREIGN PATENT DOCUMENTS

CN 201475725 U 5/2010
CN 201779492 U 3/2011
(Continued)

OTHER PUBLICATIONS

International Search Report based on Application No. PCT/EP2014/061034 (4 pages) dated Jul. 14, 2014 (Reference Purpose Only).

*Primary Examiner* — William N Harris
(74) *Attorney, Agent, or Firm* — Hayes Soloway PC

(57) ABSTRACT

Various embodiments may relate to an end cap for a lamp tube of an illuminating device, including a mounting ring fixedly mounted to one end of the lamp tube by means of an assembled end, and a cover plate for closing the mounting ring at a free end. The end cap further includes a rotating ring mounted between the mounting ring and the cover plate at the free end, the cover plate rotatably closes the mounting ring by means of the rotating ring. Further various embodiments relate to an illuminating device adopting the end cap.

19 Claims, 4 Drawing Sheets

(51) Int. Cl.

| | |
|---|---|
| ***F21V 23/00*** | (2015.01) |
| ***F21Y 103/10*** | (2016.01) |
| ***F21Y 115/10*** | (2016.01) |
| ***F21K 9/278*** | (2016.01) |
| ***F21K 9/65*** | (2016.01) |
| ***F21V 14/02*** | (2006.01) |

(52) U.S. Cl.
CPC ..... *F21V 14/02* (2013.01); *F21V 21/30* (2013.01); *F21Y 2103/10* (2016.08); *F21Y 2115/10* (2016.08)

(56) References Cited

U.S. PATENT DOCUMENTS

| | | | | |
|---|---|---|---|---|
| 2010/0103659 | A1* | 4/2010 | Chen | F21S 6/003 362/231 |
| 2011/0194278 | A1* | 8/2011 | Yang | F21K 9/65 362/217.12 |
| 2011/0194296 | A1* | 8/2011 | Chou | F21V 19/02 362/362 |
| 2011/0286208 | A1 | 11/2011 | Chen | |
| 2013/0250583 | A1* | 9/2013 | Chang | F21V 3/02 362/362 |

FOREIGN PATENT DOCUMENTS

| | | | |
|---|---|---|---|
| CN | 102155656 | B | 2/2013 |
| EP | 2194315 | A1 | 6/2010 |
| JP | 2012009377 | A | 1/2012 |
| WO | 2012129813 | A1 | 10/2012 |

* cited by examiner

END CAP OF LAMP TUBE AND ILLUMINATING DEVICE USING SAID END CAP

RELATED APPLICATIONS

The present application is a national stage entry according to 35 U.S.C. § 371 of PCT application No.: PCT/EP2014/061034 filed on May 28, 2014, which claims priority from Chinese application No.: 201310240844.9 filed on Jun. 18, 2013, and is incorporated herein by reference in its entirety.

TECHNICAL FIELD

Various embodiments may relate to an end cap for a lamp tube of an illuminating device and an illuminating device adopting said end cap.

BACKGROUND

With the wide application and rapid development of LED technology, illuminating devices using LEDs as light sources are widely used, e.g. bulbs for daily use, spotlights, and stage illuminating etc. With further development of illuminating devices, LED illuminating devices having light sources for wide range illumination have attracted increasingly more attention in the aspect of packaging, and requirements concerning industrial protection, e.g. water and dust proofness, also become higher and higher. In order to satisfy the requirements on rotatable tubular LEDs, more and more LED illuminating devices of said type appear on the market. However, most rotatable LED illuminating devices have complicated structures, and require relatively large space; moreover, due to an unsatisfactory mounting position of a driver of the illuminating devices, the luminous effect of an illuminating device of said type is greatly affected.

A solution according to the relate art provides the use of a lamp tube having an elliptical cross-section so as to solve the above problem, in which it attempts to enlarge the accommodating space so as to achieve the object of accommodating the driver of the illuminating device. However, such a solution might bring detrimental security risks due to an enlarged volume of the illuminating device. Moreover, said solution requires relatively high production costs.

SUMMARY

Various embodiments provide an end cap of a lamp tube and an illuminating device adopting said end cap. Said novel end cap not only realizes a rotatable effect, but also enable easy production and assembly because of a simple structure of the end cap. In addition, the design of said end cap enables said end cap to only occupy a relatively small space, and because the end cap provides an appropriate accommodating space, the driver of the illuminating device can be fixed and accommodated in said end cap, so as to avoid detrimental influence on luminous effect of the illuminating device caused by an unsatisfactory mounting position of the driver.

Various embodiments provide an end cap for a lamp tube of an illuminating device, said end cap includes: a mounting ring fixedly mounted to one end of the lamp tube by means of an assembled end, and a cover plate for closing the mounting ring at a free end; and said end cap further includes a rotating ring mounted between the mounting ring and the cover plate at the free end, and the cover plate rotatably closes the mounting ring by means of the rotating ring. Said rotating ring can not only seal the space between the cover plate and the mounting ring, but also achieve the object of enabling rotation of the mounting ring.

In various embodiments, the cover plate is rotatable with respect to the rotating ring. In this case, the object for relative rotation between the mounting ring and the cover plate can be achieved.

In various embodiments, the rotating ring is capable of rotating with respect to the mounting ring in a first rotation direction, and the cover plate is capable of rotating with respect to the rotating ring in a second rotation direction opposite to the first rotation direction. Through such a solution, the mounting ring can rotate with respect to the cover plate in different directions.

In various embodiments, the mounting ring is configured as a hollow cylinder, the inner cavity of the hollow cylinder forms an accommodating cavity for accommodating an electronic assembly of the illuminating device. In this case, said hollow structure can provide the illuminating device with the possibility of accommodating e.g. the driver, and hereby, an addition design for the lamp tube of the illuminating device is no longer necessary for the purpose of accommodating the driver.

In various embodiments, a journal is formed on the mounting ring at the free end and sleeved with the rotating ring by means of a first opening end, and a second opening end of the rotating ring is closed with the cover plate. Through such a design, the connection between the mounting ring and the rotating ring and the connection between the cover plate and the rotating ring can be realized, so as to realize the assembly of the components.

In various embodiments, a first meshing part is formed on the journal, and a second meshing part is formed on the first opening end of the rotating ring, the rotating ring rotates with respect to the mounting ring by the interaction between the first meshing part and the second meshing part. When the rotating ring rotates with respect to the mounting ring, the first meshing part firstly disengages with the second meshing part, and then a further relative rotation enables that the first meshing part engages with the second meshing part again, so as to realize the possibility of gradually regulating the rotation angle of the mounting ring.

In various embodiments, the first meshing part is configured as a plurality of first teeth tilting towards the first rotation direction and being distributed on the circumference of the journal, and the second meshing part is configured as a plurality of first tooth spaces distributed on the circumference of the first opening end of the rotating ring, wherein after disengaging from one of the first tooth spaces, the first tooth is capable of engaging with another first tooth space, when the rotating ring rotates in the first rotation direction. The action of engagement of a tooth with a tooth space after disengaging from an adjacent tooth space corresponds an adjusting stage. It has to be emphasized hereby that the amount of the teeth and the amount of the tooth spaces determine the adjustment accuracy of the rotating ring with respect to the mounting ring; in other words, the more the amounts of the teeth and the tooth grooves, the smaller the rotation angle corresponding to each adjusting stage, which then results in a more accurate adjustment of the orientation of the lamp tube of the illuminating device.

In various embodiments, a first guiding part is formed on the journal, and a second guiding part is formed on the rotating ring, the rotation process of the rotating ring with respect to the mounting ring is guided by the interaction between the first guiding part and the second guiding part. Such a design can not only achieve a stable connection between two parts, but also realizes limitating relative movement of the two parts in a circumferential direction.

In various embodiments, the first guiding part is an annular groove being formed on the journal and extending in a circumferential direction of the journal, and the second guiding part is a projection being formed on the inner wall of the rotating ring and at least partially extending in a circumferential direction of the rotating ring, the projection engages with the annular groove and is capable of sliding in the annular groove along with the rotation of the rotating ring. In this case, the connection between two parts can be simply realized through the design of a projection and a groove, and the object of limiting the relative rotation of the two parts in the circumferential direction can hereby be achieved.

In various embodiments, a third meshing part is formed on the cover plate, a fourth meshing part is formed on the second opening end of the rotating ring, and the rotating ring rotates with respect to the cover plate by the interaction between the third meshing part and the fourth meshing part. Through the interconnection between the two meshing parts, the connection between the cover plate and the rotating ring can be realized, and the object of rotating the cover plate with respect to the rotating ring can be achieved.

In various embodiments, the third meshing part is configured as a plurality of second teeth formed on a circumferential edge of the cover plate, the second teeth tilting towards the first rotation direction; and the fourth meshing part is configured as a plurality of second tooth spaces formed on the second opening end of the rotating ring and distributed on the circumference, wherein after disengaging from one of the second tooth spaces, the second tooth is capable of engaging with another second tooth space, when the cover plate rotates with respect to the rotating ring in the second rotation direction. According to various embodiments, the object of having a rotation direction of the cover plate with respect to the mounting ring being different to that of the mounting ring with respect to the cover plate can be achieved. Likewise, the amount of the teeth and that of the tooth spaces determine the adjustment accuracy of the cover plate with respect to the rotating ring.

In various embodiments, a support beam extending in the diameter of the free end is formed in the free end of the mounting ring, and a via is formed in the center of the support beam. The via provided in the center of the support beam is used as a center of rotation of the rotating ring and the cover plate.

In various embodiments, a threaded hole is formed at the center of the cover plate, and a bolt is screwed in the threaded hole through the via. In this case, a firm mechanical connection between the mounting ring and the cover plate can be realized through the rotating ring.

In various embodiments, a cylindrical rotation shaft extending from a surface of the cover plate is formed at the center of the cover plate, the rotation shaft is configured to be capable of being at least partially inserted into the via and rotating in the via. The design according to the present disclosure assures that relative movement, preferably, relative rotation in a circumferential direction, between two parts can be realized.

In various embodiments, two pins for electrical connection are provided on the cover plate. The design according to the present disclosure can realize an electrical connection of the lamp tube in connection with the cover plate by means of a relatively small space.

Various embodiments further relate to an illuminating device, said illuminating device includes: a lamp tube; a light source provided in the lamp tube; and an electronic device for driving the light source, wherein the illuminating device further includes an end cap of the above mentioned type. Such an illuminating device can rotate at the end cap in a circumferential direction to achieve the object of adjusting illuminating direction, without derogating luminous effect.

In various embodiments, the lamp tube is configured as a cylindrical lamp tube, the two opening ends of the lamp tube are respectively closed by an end cap. According to such a design, the lamp tube is in connection with the end cap in two directions to realize the object for simultaneous rotation of the whole lamp tube at both ends.

In various embodiments, the electronic device is provided in the end cap. The arrangement of the electronic device, e.g. a driver, in the end cap can save the structure space of the whole illuminating device, without detrimental influence on the luminous effect of the illuminating device.

It is provided that the light source is configured as an LED light source. LED technology can achieve the advantages of energy saving, high efficiency, and long service life etc.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
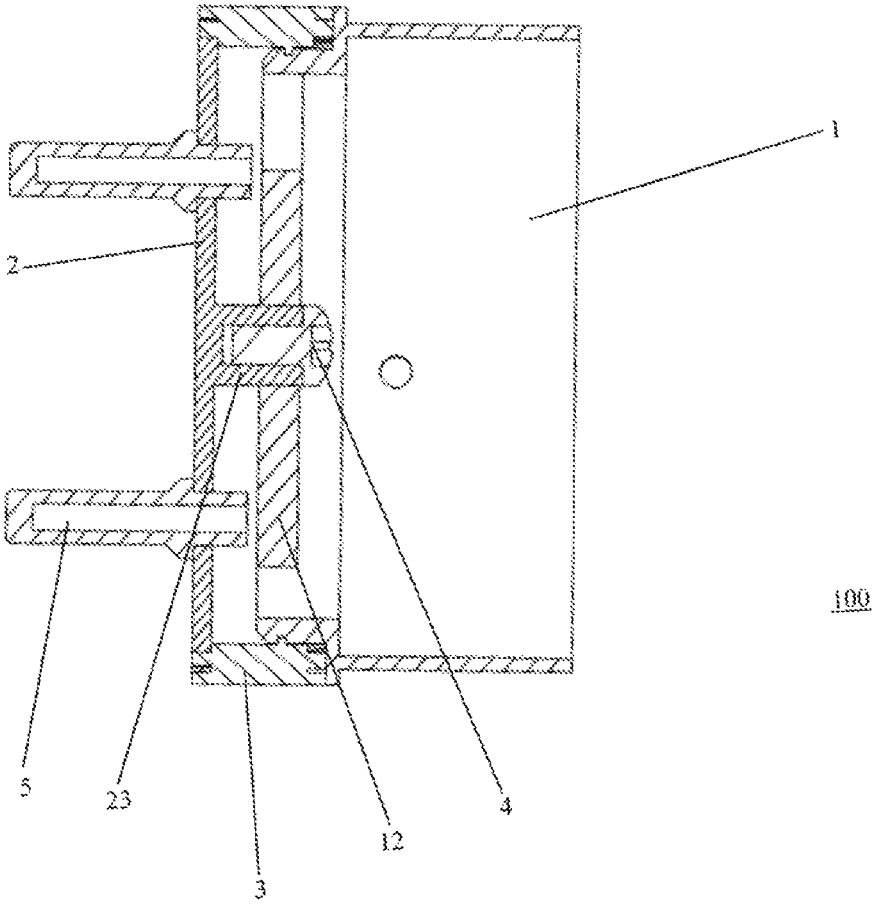
FIG. 1 is a sectional view of an end cap according to various embodiments.

According to various embodiments, the designed end cap 100 has main parts such as a mounting ring 1, a rotating ring 3, and a cover plate 2, and as shown in FIG. 1, FIG. 1 is a sectional view of an end cap 100 according to various embodiments. It can be seen from the figure that said end cap 100 successively includes a mounting ring 1, a rotating ring 3, and a cover plate 2 in an axial direction, and the object of assembling the end cap 100 can be realized through the interconnection of the above three main parts. A support beam 12 is provided in the end cap 100, and a via is also provided in the support beam 12. Moreover, a cylindrical rotation shaft 23 is configured on the cover plate 2, and in this case, a bolt 4 is in connection with the rotation shaft 23 through the via, in which the object of connecting the mounting ring 1, the rotating ring 3, and the cover plate 2 is achieved. In the following contents, the structure of said end cap 100 is explained by means of exploded views of said end cap 100 in different directions.

Figure 2:
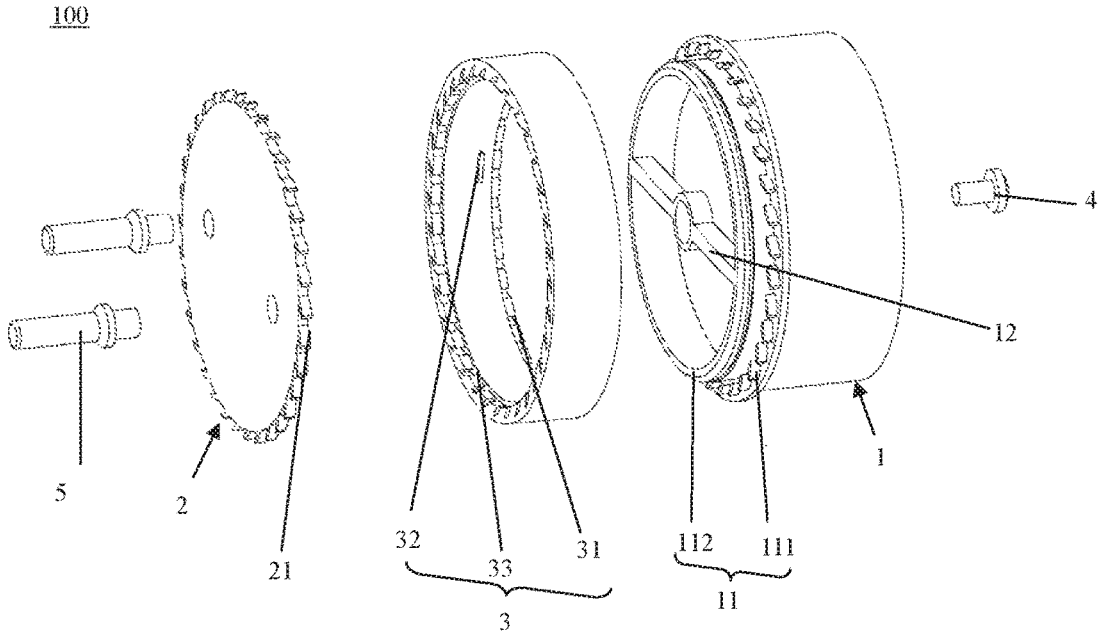
FIG. 2 is an exploded view of the end cap according to the present invention in a direction.
Figure 4:
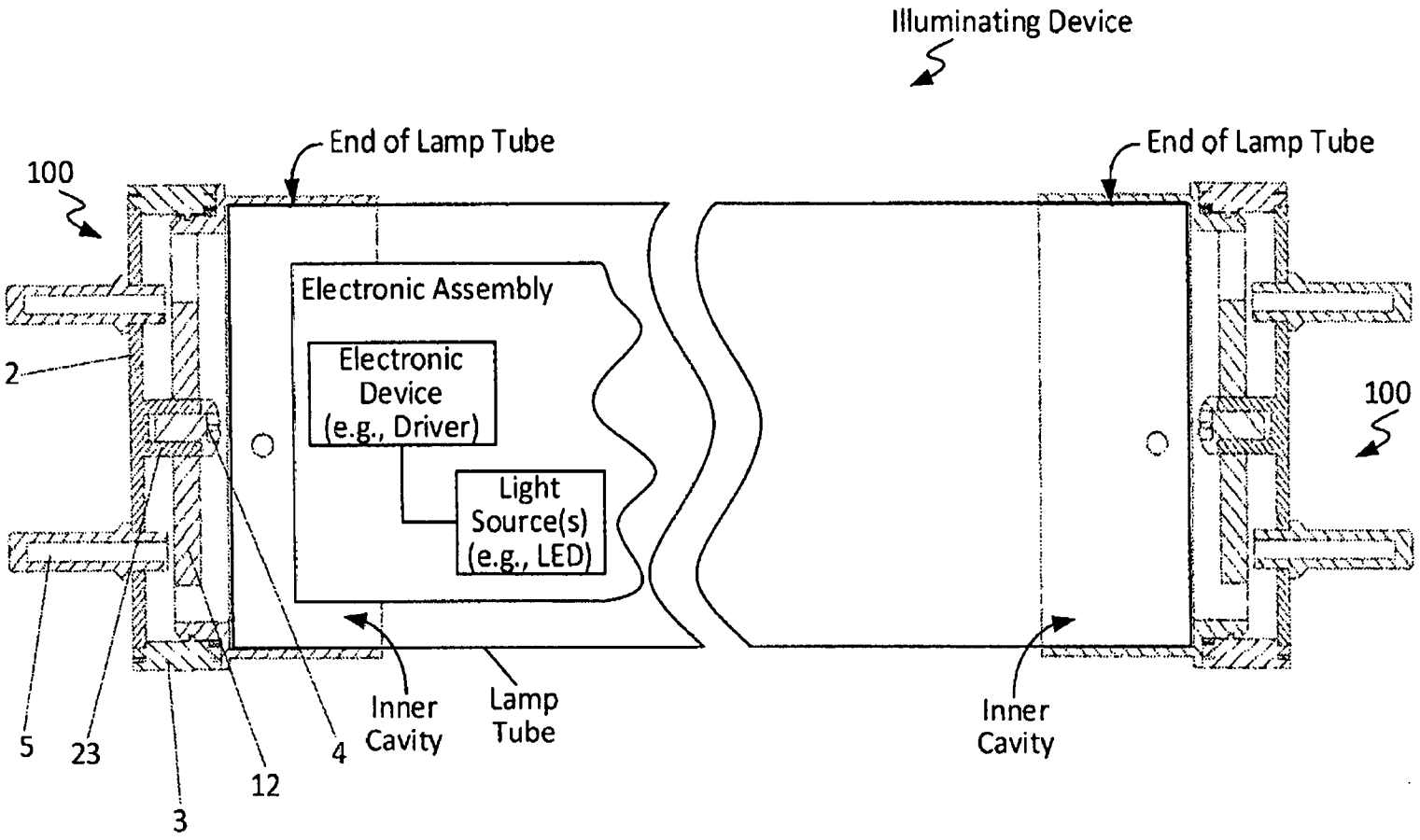
FIG. 4 is a sectional view of an illuminating device including end caps according to the present invention.

FIG. 2 is an exploded view of the end cap 100 according to various embodiments in a direction. As shown in FIG. 2, said end cap 100 successively includes s a pin for electrical connection 5, a cover plate 2, a rotating ring 3, a mounting ring 1, and a bolt 4 in the axial direction, wherein the mounting ring 1 can be configured as a hollowed-out cylinder, and in this case, an electronic device such as a driver etc. can be provided in said mounting ring 1; moreover, the electronic device can be in electrical connection with a power source through the pin for electrical connection 5, and in this case, the structure space of the illuminating device can be reduced, and the effect of rationally arranging the mounting position of the electronic device can hereby be realized. One free end of the mounting ring 1 can be in connection with the lamp tube, and a light source utilizing LED technology is provided in the lamp tube, which is not only energy saving, but also can prolong the service life of the illuminating device. For instance, consider FIG. 4, which is a sectional view of an illuminating device including end caps 100 according to an embodiment. A journal 11 is formed at the other free end of the mounting ring I , and a plurality of first teeth 111 is provided on the circumference of said journal 11, wherein said teeth 11 are distributed on the journal 11 in a circumferential direction, preferably in a first rotation direction, e.g. in a clockwise direction or an anti-clockwise direction. In addition, an annular groove 112 is also provided on said journal 11, and said annular groove 112 is also distributed in a circumferential direction of said journal 11. In this case, the rotating ring 3 can be sleeved on the mounting ring 1 by means of the journal 11, and the mounting ring 1 can be in connection with tooth spaces 31 (which will be introduced in the following content) of the rotating ring 3 in a meshing manner through the teeth 111, viz. said first teeth 111 can respectively engage with a tooth space 31 after disengaging from another tooth space 31, and moreover, a connection between the mounting ring 1 and the rotating ring 3 and a rotating effect in a circumferential direction can be realized through the connection of the groove with a projection 32 (which will be introduced in the following content) of the rotating 3 in an e.g. embedded manner.

In addition, a support beam 12 is further provided in a diameter direction of the mounting ring 1, and said support beam 12 can be preferably configured in a rod shape and extend from one of the inner wall of the mounting ring 1 through the circle center to the other end of the inner wall. In this case, a via 121 is provided at a central position of said support beam 12, viz. the circle center of said mounting ring 1, so as to realize the possibility of connecting the mounting ring 1 with other parts of the end cap 100 through e.g. a bolt. Thus, a rotation of 180° in e.g. the first rotation direction, or in a second rotation direction opposite to the first rotation direction can be realized, after the mounting ring 1 has been connected to the cover plate 2 through the rotating ring 3.

As shown in FIG. 2, tooth spaces 31 and tooth spaces 33 are respectively provided at the two opening ends of the rotating ring 3, and a projection 32 is further provided on the inner wall of the rotating ring 3. The first tooth 111 of the mounting ring 1 can form a meshed connection structure with the first groove space 31; moreover, the projection 32 is used as a first guiding part, and the annular groove 112 is used as a second guiding part; when the projection 32 is embedded in the annular groove 112 of the mounting ring 1, the mounting ring 1 is in connection with the rotating ring 3; and along with the rotation of the rotating ring 3 or the mounting ring 1, said projection 32 can slide within and along the groove 112. And because of the interaction between the projection 32 and the groove 112, the relative movement direction of the mounting ring 1 and the rotating ring 3, e.g. a relative rotation in a circumferential, clockwise, or anti-clockwise direction, is defined. In this case, the relative rotation between the two parts can be realized.

By means of second tooth spaces 33 on the rotating ring 3, the cover plate 2 can be in an interconnection with the rotating ring 3 in a meshing manner, viz. after disengaging from one second tooth space 33, the second tooth 21 can engage with another second tooth space 33 and close the rotating ring 3 at one of the opening ends. In this case, the cover plate 2 can rotationally move with respect to the rotating ring 3 in a circumferential direction, and simultaneously, because of the meshing connection of the first tooth spaces 31 of the rotating ring 3 with the mounting ring 1, the rotation of the cover plate 2 with respect to the mounting ring 1 in e.g. the first rotation direction can also be realized, while the cover plate 2 rotates with respect to the rotating ring 3 in the first rotation direction. Likewise, when the mounting ring 1 rotates with respect to the rotating ring 3 in the second rotation direction differing from the first rotation direction, a rotation with respect to the cover plate 2 in the second rotation direction is also realized. In this case, the effect of a relative rotation between the mounting ring 1 and the cover plate 2 in two different rotation directions can be achieved, and the object of e.g. adjusting illuminating direction of the lamp tube can hereby be achieved. At least one through hole is further provided on the cover plate 2, said through hole penetrates the cover plate 2 in an axial direction, the pin for electrical connection 5 can e.g. partially penetrate the through hole and abuts on the surface of the cover plate 2 in a manner of being in connection with the cover plate 2, and in this way, e.g. the material of an electric wire can extend into the inside of the end cap through the through hole.

Figure 3:
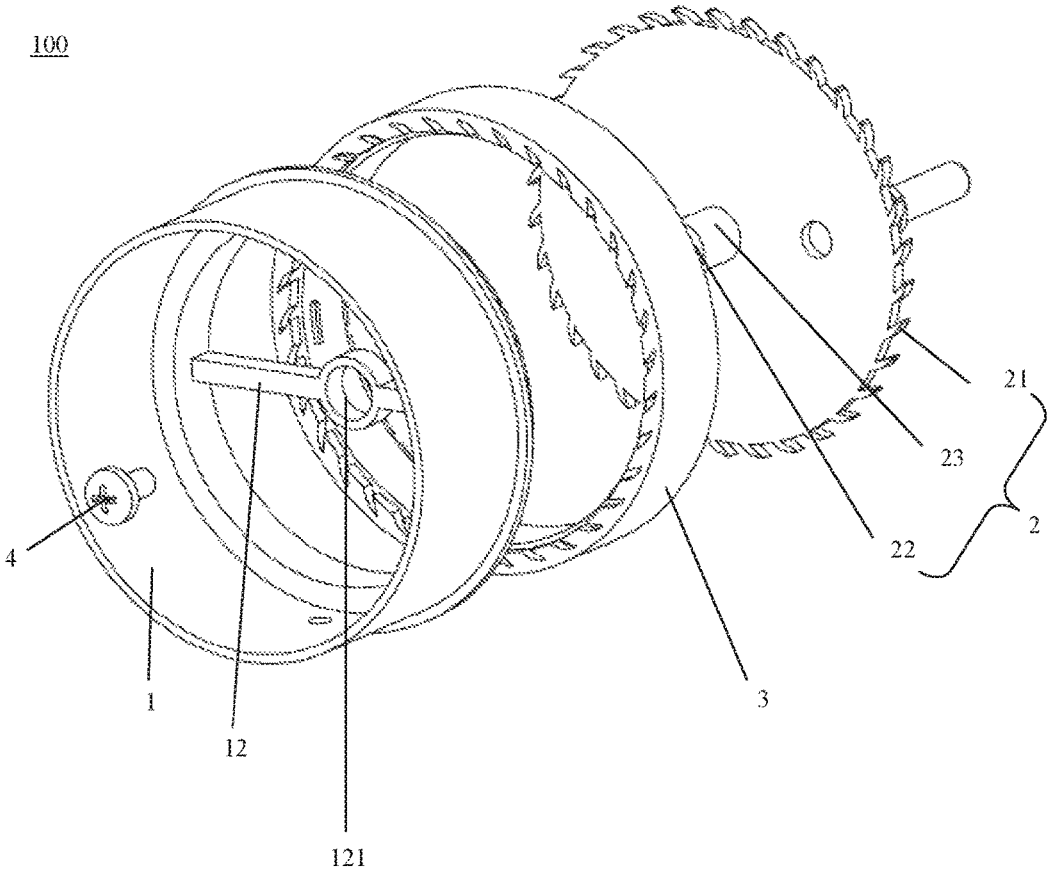
FIG. 3 is an exploded view of the end cap according to the present invention in another direction.

Moreover, with reference to FIG. 3, FIG. 3 shows an exploded view of the end cap 100 according to various embodiments in another direction, wherein the rotation shaft 23 is provided on one surface of the cover plate 2, and a threaded hole 22 is further arranged in said rotation shaft 23, the rotation shaft 23 extends from the center of the cover plate 2 and has a diameter smaller than the diameter of the via 121. In this case, when the cover plate 2 is in connection with the mounting ring 1 through the rotating ring 3, said rotation shaft 23 can be inserted into the via 121, can e.g. fit the inner wall of the via 121, and form a freely relatively rotatable connection structure. Through such a connection structure and by means of the threaded hole 22 provided in the rotation shaft 23, a bolt 4 can firmly connect the mounting ring 1 with the cover plate 2 in the axial direction through the via 121 formed in the support beam 12 after the bolt has been screwed in the rotation shaft 23, while the mounting ring 1 and the cover plate 2 can still freely rotate with respect to each other in the axial direction.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An end cap for a lamp tube of an illuminating device, the end cap comprising:

a mounting ring configured to be fixedly mounted to one end of the lamp tube by means of an assembled end;

a cover plate for closing the mounting ring at a free end; and a rotating ring mounted between the mounting ring and the cover plate at the free end;

wherein the cover plate rotatably closes the mounting ring by means of the rotating ring; and wherein a support beam extending in a diameter of the free end is formed in the free end of the mounting ring, and a via is formed in a center of the support beam.

2. The end cap according to claim 1, wherein the cover plate is rotatable with respect to the rotating ring.

3. The end cap according to claim 2, wherein the rotating ring is capable of rotating with respect to the mounting ring in a first rotation direction, and the cover plate is capable of rotating with respect to the rotating ring in a second rotation direction opposite to the first rotation direction.

4. The end cap according to claim 3, wherein the mounting ring is configured as a hollow cylinder, and an inner cavity of the hollow cylinder forms an accommodating cavity for accommodating an electronic assembly of the illuminating device.

5. The end cap according to claim 4, wherein a journal is formed on the mounting ring at the free end and sleeved with the rotating ring by means of a first opening end of the rotating ring, and a second opening end of the rotating ring is closed with the cover plate.

6. The end cap according to claim 5, wherein a first meshing part is formed on the journal, and a second meshing part is formed on the first opening end of the rotating ring, and the rotating ring rotates with respect to the mounting ring by the interaction between the first meshing part and the second meshing part.

7. The end cap according to claim 6, wherein the first meshing part is configured as a plurality of first teeth tilting towards the first rotation direction and being distributed on a circumference of the journal, and the second meshing part is configured as a plurality of first tooth spaces distributed on a circumference of the first opening end of the rotating ring, wherein after disengaging from one of the first tooth spaces, the first tooth is capable of engaging with another first tooth space, when the rotating ring rotates in the first rotation direction.

8. The end cap according to claim 5, wherein a first guiding part is formed on the journal, a second guiding part is formed on the rotating ring, and the rotation process of the rotating ring with respect to the mounting ring is guided by the interaction between the first guiding part and the second guiding part.

9. The end cap according to claim 8, wherein the first guiding part is an annular groove being formed on the journal and extending in a circumferential direction of the journal, the second guiding part is a projection formed on an inner wall of the rotating ring and at least partially extending in a circumferential direction of the rotating ring, and the projection engages with the annular groove and is capable of sliding in the annular groove along with the rotation of the rotating ring.

10. The end cap according to claim 5, wherein a third meshing part is formed on the cover plate, a fourth meshing part is formed on the second opening end of the rotating ring, and the rotating ring rotates with respect to the cover plate by the interaction between the third meshing part and the fourth meshing part.

11. The end cap according to claim 10, wherein the third meshing part is configured as a plurality of second teeth formed on a circumferential edge of the cover plate, the second teeth tilting towards the first rotation direction, and the fourth meshing part is configured as a plurality of second tooth spaces formed on the second opening end of the rotating ring and distributed on the circumference, wherein after disengaging from one of the second tooth spaces, the second tooth is capable of engaging with another second tooth space, when the cover plate rotates with respect to the rotating ring in the second rotation direction.

12. The end cap according to claim 1, wherein a threaded hole is formed at a center of the cover plate, and a bolt is screwed in the threaded hole through the via.

13. The end cap according to claim 12, wherein a cylindrical rotation shaft extending from a surface of the cover plate is formed at the center of the cover plate, and the rotation shaft is configured to be capable of being at least partially inserted into the via and rotating in the via.

14. The end cap according to claim 1, wherein two pins for electrical connection are provided on the cover plate.

15. An illuminating device comprising:

a lamp tube;

a light source provided in the lamp tube;

an electronic device for driving the light source; and at least one end cap comprising:

a mounting ring fixedly mounted to one end of the lamp tube by means of an assembled end;

a cover plate for closing the mounting ring at a free end; and a rotating ring mounted between the mounting ring and the cover plate at the free end;

wherein the cover plate rotatably closes the mounting ring by means of the rotating ring; and wherein a support beam extending in a diameter of the free end is formed in the free end of the mounting ring, and a via is formed in a center of the support beam.

16. The illuminating device according to claim 15, wherein the at least one end cap comprises two end caps, the lamp tube is configured as a cylindrical lamp tube, and two opening ends of the lamp tube are respectively closed by the two end caps.

17. The illuminating device according to claim 15, wherein the electronic device is arranged in the at least one end cap.

18. The illuminating device according to claim 15, wherein the light source is configured as an LED light source.

19. The illuminating device according to claim 1, wherein the cover plate is co-planar with the mounting ring.

* * * * *